US009933150B2

(12) United States Patent
Korenek et al.

(10) Patent No.: US 9,933,150 B2
(45) Date of Patent: Apr. 3, 2018

(54) HANDS-FREE WEARABLE LIGHTING DEVICE

(71) Applicants: Carrie R. Korenek, Elmaton, TX (US); Paul Allen Korenek, Elmaton, TX (US)

(72) Inventors: Carrie R. Korenek, Elmaton, TX (US); Paul Allen Korenek, Elmaton, TX (US)

( * ) Notice: Subject to any disclaimer, the term of this patent is extended or adjusted under 35 U.S.C. 154(b) by 37 days.

(21) Appl. No.: 15/049,260

(22) Filed: Feb. 22, 2016

(65) Prior Publication Data

US 2017/0138585 A1 May 18, 2017

Related U.S. Application Data

(60) Provisional application No. 62/255,831, filed on Nov. 16, 2015.

(51) Int. Cl.

| | |
|---|---|
| ***F21V 33/00*** | (2006.01) |
| ***F21V 23/00*** | (2015.01) |
| ***F21V 23/04*** | (2006.01) |
| ***F21S 9/02*** | (2006.01) |
| ***F21V 3/00*** | (2015.01) |
| ***F21V 23/06*** | (2006.01) |
| ***F21V 17/10*** | (2006.01) |
| ***F21V 15/01*** | (2006.01) |
| ***A44C 15/00*** | (2006.01) |
| *F21Y 115/10* | (2016.01) |
| *F21Y 115/30* | (2016.01) |

(52) U.S. Cl.

CPC ..... *F21V 33/0008* (2013.01); *A44C 15/005* (2013.01); *A44C 15/0015* (2013.01); *F21S 9/02* (2013.01); *F21V 3/00* (2013.01); *F21V 15/01* (2013.01); *F21V 17/107* (2013.01); *F21V 23/003* (2013.01); *F21V 23/04* (2013.01); *F21V 23/06* (2013.01); *F21Y 2115/10* (2016.08); *F21Y 2115/30* (2016.08)

(58) Field of Classification Search

None

See application file for complete search history.

(56) References Cited

U.S. PATENT DOCUMENTS

| | | | | |
|---|---|---|---|---|
| 7,478,923 | B2 * | 1/2009 | Hsu | H05B 33/0821 257/99 |
| 9,078,495 | B2 * | 7/2015 | Rife | A44C 15/0015 |
| 2004/0080621 | A1 * | 4/2004 | Fisher | H04N 5/262 348/207.99 |

(Continued)

*Primary Examiner* — Sharon Payne

(57) ABSTRACT

A hands-free wearable lighting device is a device utilized to provide illumination to the user's surroundings while being worn. At least one multicolor light-emitting diode (LED) is positioned within an LED compartment located on a housing. A control unit, a brightness adjustment switch, and a color adjustment switch allow the user to alter the light of the at least one multicolor LED. A necklace allows the housing to be worn around the user's neck in order to provide hands-free illumination. The user may utilize the device as a handheld light by grasping the device via a finger tab. Additionally, the user may utilize a prop stand to direct the light from the at least one multicolor LED in a desired direction. The device may include a laser diode as well in order to allow the device to emit a laser in addition to regular illumination.

7 Claims, 10 Drawing Sheets

DETAIL A

(56) References Cited

U.S. PATENT DOCUMENTS

| | | | | |
|---|---|---|---|---|
| 2009/0012433 | A1* | 1/2009 | Fernstrom | A61B 5/1112<br>600/593 |
| 2009/0044566 | A1* | 2/2009 | Underdown | A44C 15/0015<br>63/3 |
| 2015/0316698 | A1* | 11/2015 | Resnick | F21V 33/0008<br>362/555 |

* cited by examiner

DETAIL A

DETAIL B

DETAIL C

DETAIL D

HANDS-FREE WEARABLE LIGHTING DEVICE

The current application claims a priority to the U.S. Provisional Patent application Ser. No. 62/255,831 filed on Nov. 16, 2015.

FIELD OF THE INVENTION

The present invention relates generally to a lighting device for providing illumination to a user's surroundings. More specifically, the present invention is a hands-free wearable lighting device that may be worn around the user's neck.

BACKGROUND OF THE INVENTION

More adequate illumination is often desirable during various activities including reading in an upright seating position, working in a cramped space, and while exercising outdoors. Conventional lighting devices such as flashlights, lanterns, and similar devices must be held during use and prevent the user from freely utilizing his or her hands. In addition, such devices are impractical during certain activities such as reading or exercising outdoors. In these types of situations, hands-free illumination is most practical as the user is then free to use his or her hands as needed.

The present invention is a hands-free wearable lighting device that provides illumination to the user's ambient surroundings. In its preferred embodiment, the present invention is worn around the user's neck and provides illumination in front of the user. The positioning and orientation of the present invention is adjustable in order to direct the provided illumination in the desired manner by the user. The present invention may additionally be utilized as a handheld lighting device as needed.

DETAIL DESCRIPTIONS OF THE INVENTION

Figure 1:
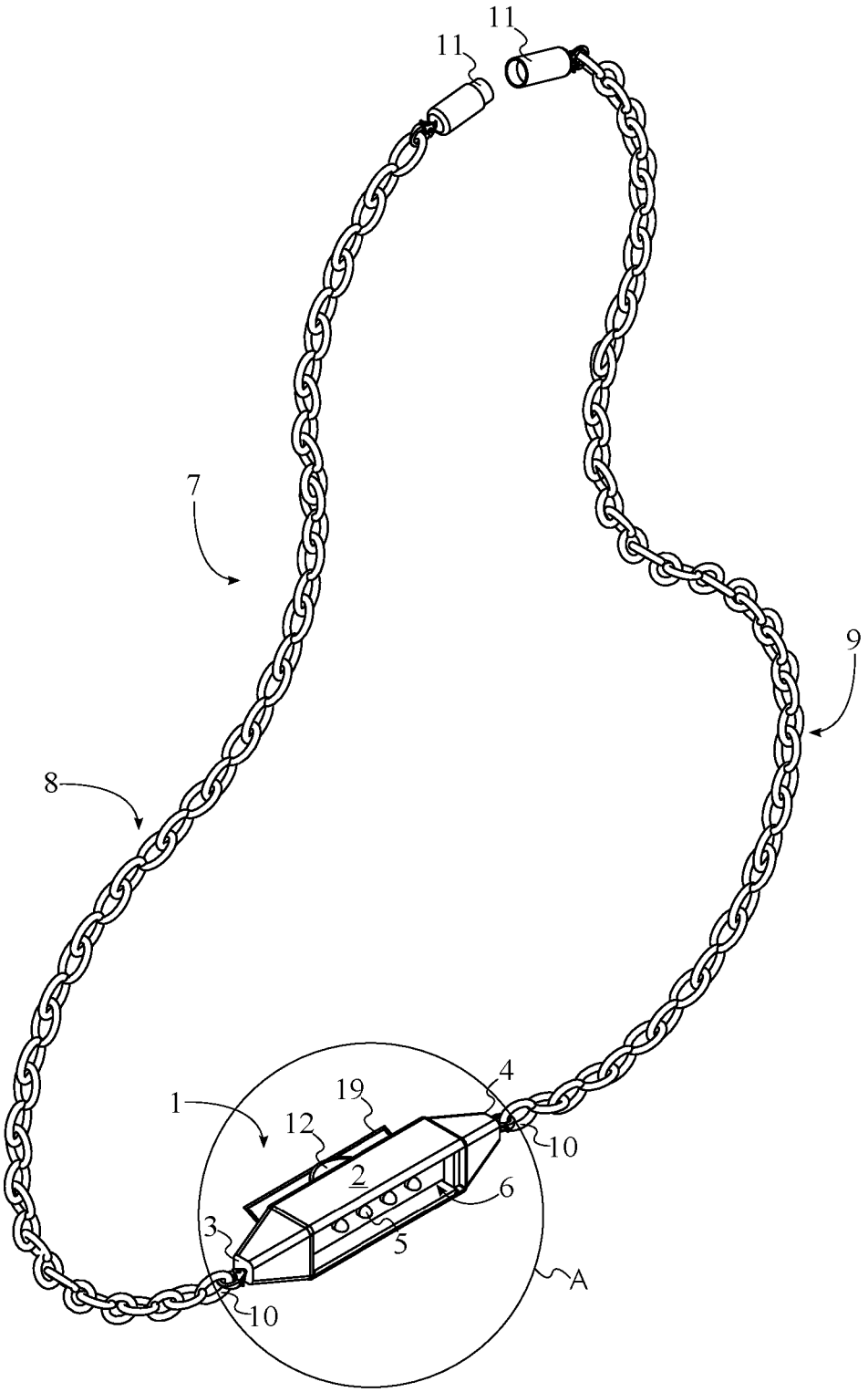
FIG. 1 is a front perspective view of the present invention.
Figure 2:
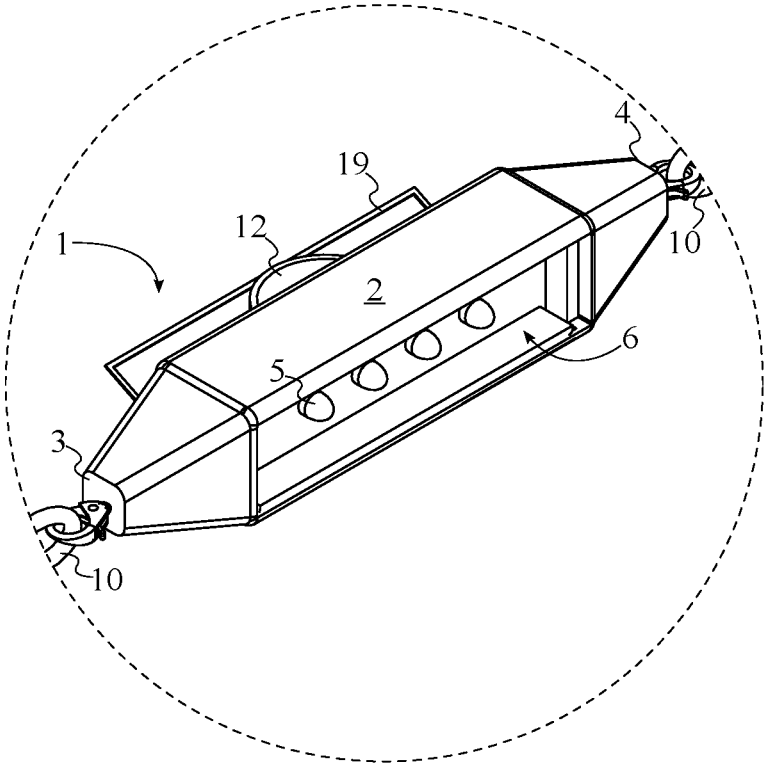
FIG. 2 is a detail view of the present invention taken from circle A of FIG. 1.

All illustrations of the drawings are for the purpose of describing selected versions of the present invention and are not intended to limit the scope of the present invention.

The present invention is a hands-free wearable lighting device for providing illumination to the user's surroundings. The present invention is shown in FIGS. 1-5 and comprises a housing 1, at least one multicolor light-emitting diode (LED) 5, an LED compartment 6, a necklace 7, a finger tab 12, and a control unit 13.

The housing 1 is a casing that provides protection and structural support for the electronic components of the present invention. The housing 1 is designed to be worn around the user's neck via the necklace 7. The necklace 7 is preferably a chain. However, alternatives for the necklace 7 such as a cord may be utilized as well. The LED compartment 6 houses the at least one multicolor LED 5 and enables light provided by the at least one multicolor LED 5 to be projected from the housing 1. The LED compartment 6 traverses into a lateral surface 2 of the housing 1 and the at least one multicolor LED 5 is positioned within the LED compartment 6. The LED compartment 6 thus provides protection for the at least one multicolor LED 5 and additionally allows light from the at least one multicolor LED 5 to project from the housing 1. The LED compartment 6 may be left open or alternatively, the LED compartment 6 may be covered by a transparent plate that allows light from the at least one multicolor LED 5 to pass through.

The control unit 13 is the electronic component that enables the user to perform a variety of actions such as turning the at least one multicolor LED 5 on or off, changing the displayed color of the at least one multicolor LED 5, and increasing or decreasing the intensity of the light provided by the at least one multicolor LED 5. The control unit 13 additionally regulates the behavior of the at least one multicolor LED 5. For example, the at least one multicolor LED 5 may be set to flash repeatedly, indicating that the user is in need of assistance. The at least one multicolor LED 5 is electronically connected to the control unit 13, enabling the control unit 13 to process user commands.

The necklace 7 is utilized to wear the present invention around the user's neck, allowing for hands-free illumination of the user's surroundings. The necklace 7 comprises a first portion 8 and a second portion 9 that enable the necklace 7 to be quickly donned or removed from around the user's neck. The first portion 8 and the second portion 9 each comprise a tethering end 10 and a fastening end 11. The tethering end 10 is the end that is attached to the housing 1. The tethering end 10 of the first portion 8 is releasably engaged to a first end 3 of the housing 1 while the tethering end 10 of the second portion 9 is releasably engaged to a second end 4 of the housing 1. This enables the housing 1 to be easily removed from the necklace 7. The releasable engagement may be via a lobster clasp or similar mechanism for quick attachment and removal of the housing 1. The fastening end 11 of the first portion 8 is releasably engaged to the fastening end 11 of the second portion 9. The necklace 7 may thus be quickly assembled or disassembled as needed. In the preferred embodiment of the present invention, the fastening end 11 of the first portion 8 and the fastening end 11 of the second portion 9 are magnetically engaged to each other, providing a secure means of assembling the necklace 7 while simultaneously enabling the necklace 7 to be quickly disassembled if needed.

While the present invention is primarily designed for hands-free use, the finger tab 12 enables the user to grasp and hold the present invention. The finger tab 12 allows the present invention to be utilized much like a handheld flashlight in lieu of hands-free use. The finger tab 12 is externally connected to the lateral surface 2, opposite to the at least one multicolor LED 5. The light provided by the at least one multicolor LED 5 is thus oriented away from the user when the user is holding the present invention via the finger tab 12.

Figure 3:
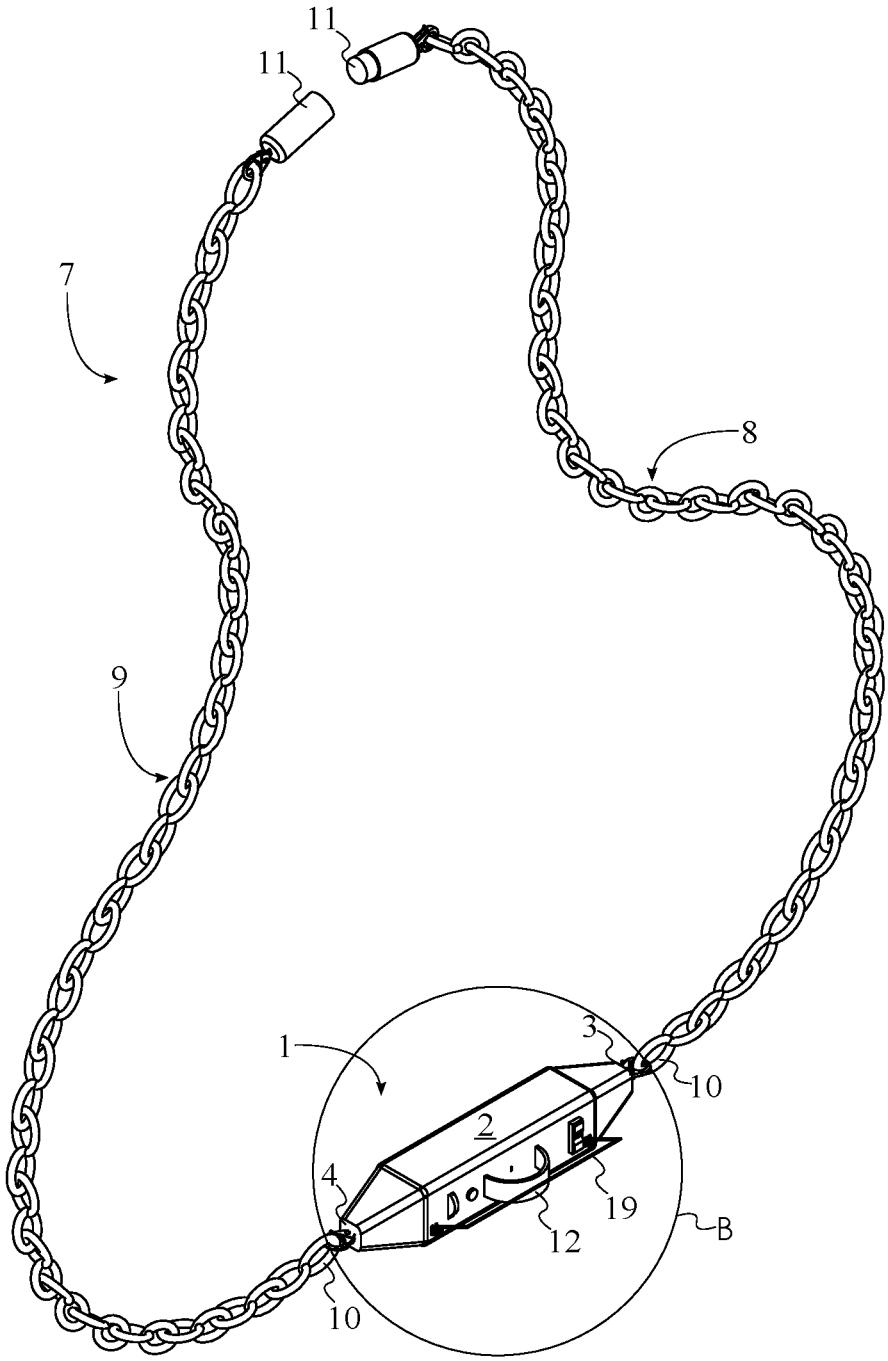
FIG. 3 is a rear perspective view of the present invention.
Figure 4:
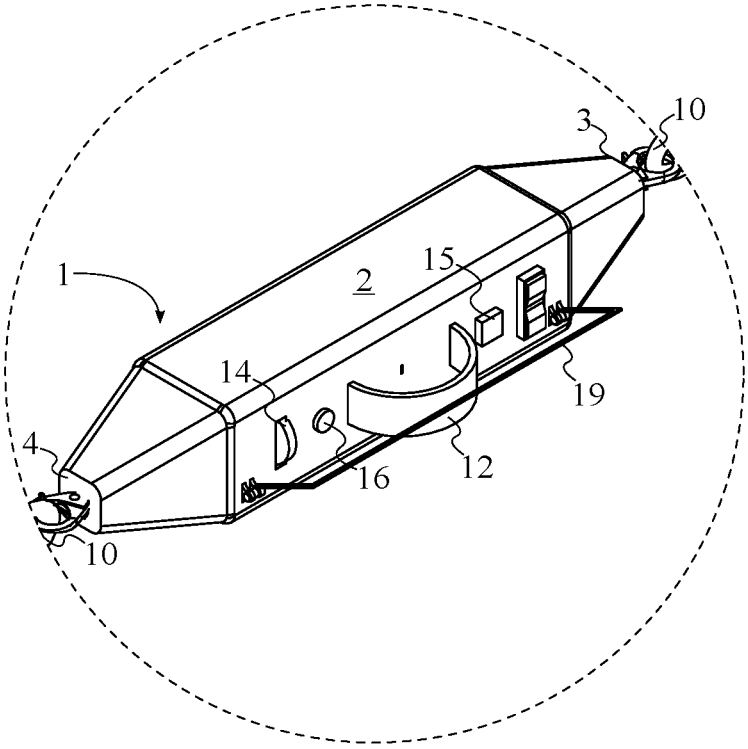
FIG. 4 is a detail view of the present invention taken from circle B of FIG. 3.
Figure 5:
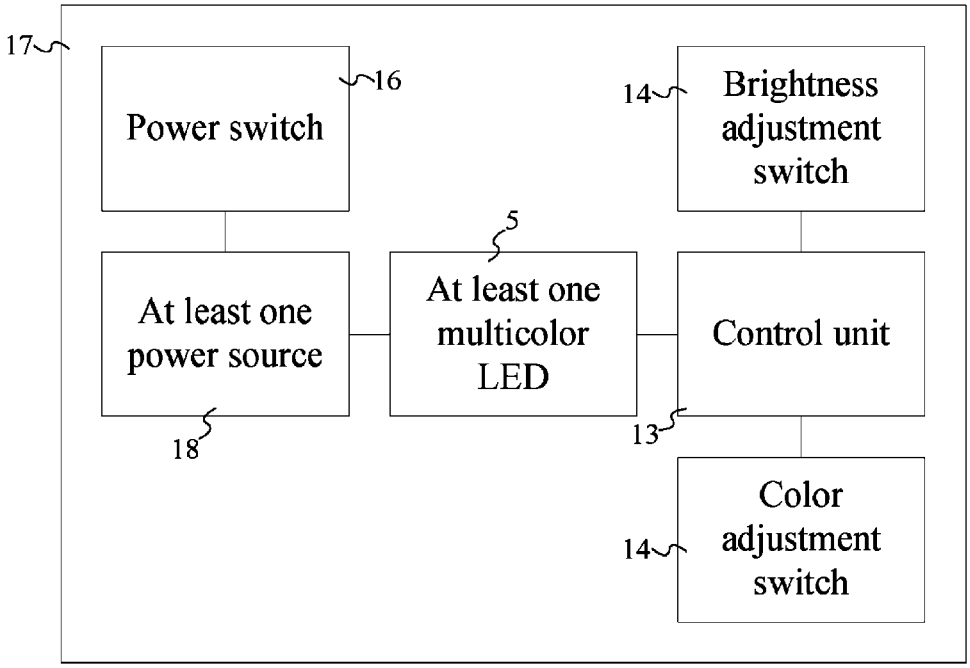
FIG. 5 is a diagram depicting electronic connections of the present invention for at least one multicolor LED.

As shown in FIG. 3 and FIG. 4, the present invention further comprises a brightness adjustment switch 14, a color adjustment switch 15, and a power switch 16. The brightness adjustment switch 14 is utilized to adjust the intensity of the light provided by the at least one multicolor LED 5. In the preferred embodiment of the present invention, the brightness adjustment switch 14 is a scroll wheel, allowing the intensity of the light provided by the at least one multicolor LED 5 to be adjusted incrementally. In this case, the brightness adjustment switch 14 is rotatably mounted into the lateral surface 2, enabling the brightness adjustment switch 14 to rotate as the intensity of the light provided by the at least one multicolor LED 5 is adjusted incrementally. The color adjustment switch 15 allows the user to select the color of the light provided by the at least one multicolor LED 5. The power switch 16 is utilized to activate and deactivate the at least one multicolor LED 5. In the preferred embodiment of the present invention, the brightness adjustment switch 14, the color adjustment switch 15, and the power switch 16 are positioned on the lateral surface 2, facilitating the user's ease of access to the aforementioned functions.

With further reference to FIGS. 1-5, the present invention further comprises a printed circuit board (PCB) 17 and at least one power source 18. The PCB 17 provides mechanical support and electrical connections for the electronic components of the present invention. The PCB 17 is seated into the LED compartment 6, providing protection for the PCB 17 and the electronic components of the present invention within the LED compartment 6. The at least one power source 18 provides electrical power to the electronic components of the present invention. The at least one power source 18 may be a rechargeable or non-rechargeable battery and is enclosed within the housing 1 for protection. The at least one power source 18 may be replaced as needed by removing the at least one power source 18 from within the housing 1. The brightness adjustment switch 14 and the color adjustment switch 15 are electronically connected to the control unit 13 through the PCB 17. User inputs through the brightness adjustment switch 14 and the color adjustment switch 15 are thus processed by the control unit 13 and implemented on the at least one multicolor LED 5. The at least one power source 18 is electrically connected to the at least one multicolor LED 5 through the PCB 17, allowing the at least one power source 18 to provide electrical power to the at least one multicolor LED 5 as well as to the other electronic components of the present invention. The power switch 16 is electrically connected to the at least one power source 18, allowing the user to activate or deactivate the at least one multicolor LED 5 via the power switch 16.

The present invention further comprises a prop stand 19 that may be used to support the housing 1 against a surface (such as the user's body) in order to direct the light provided by the at least one multicolor LED 5 in a desired direction. The prop stand 19 is hingedly connected across the lateral surface 2, opposite to the at least one multicolor LED 5. As such, the light provided by the at least one multicolor LED 5 is oriented away from the prop stand 19. The prop stand 19 may be hingedly adjusted in order to direct the light from the at least one multicolor LED 5 in the desired direction.

Figure 6:
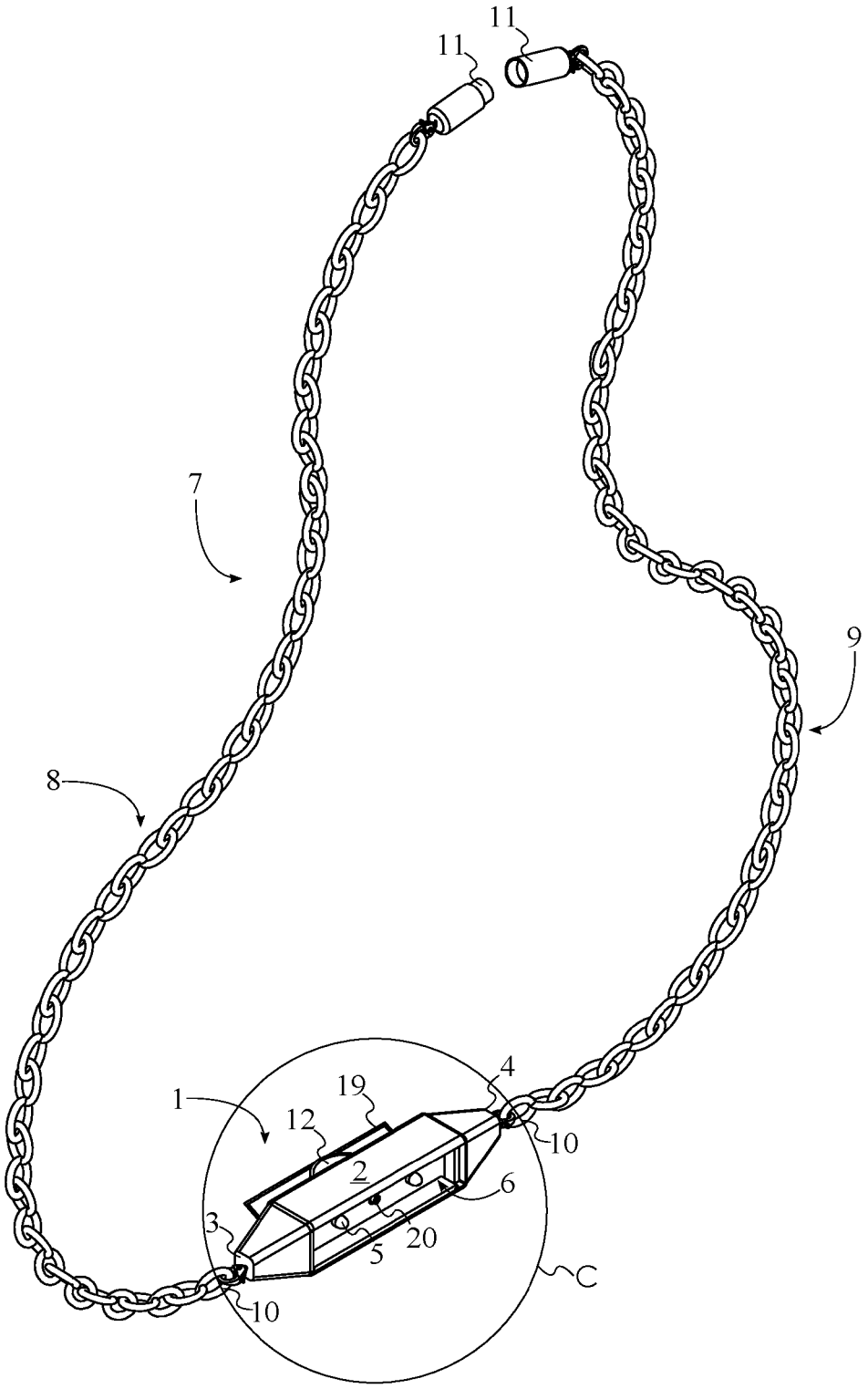
FIG. 6 is a front perspective view of an embodiment of the present invention comprising a laser diode.
Figure 7:
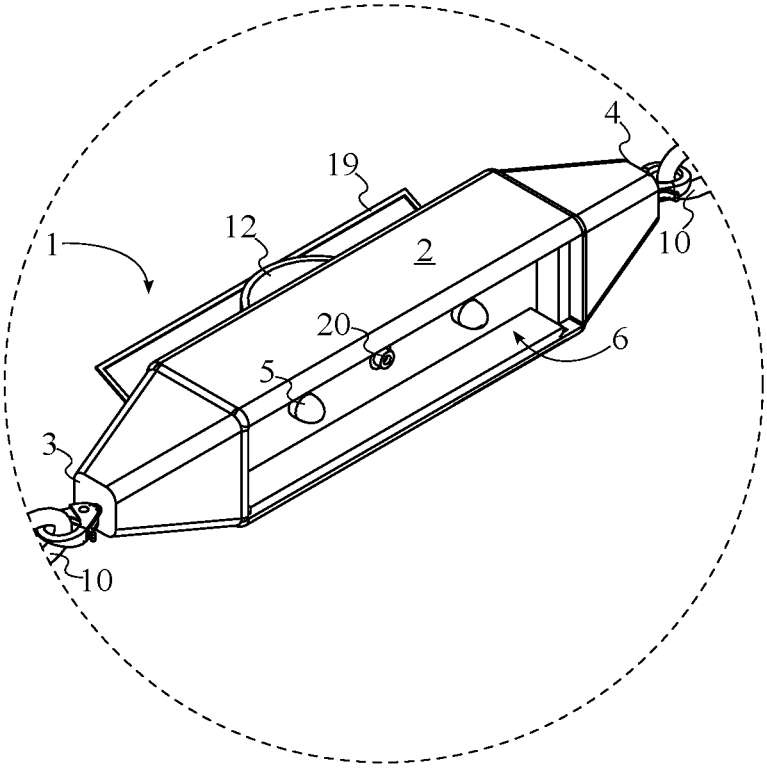
FIG. 7 is a detail view of the present invention taken from circle C of FIG. 6.
Figure 8:
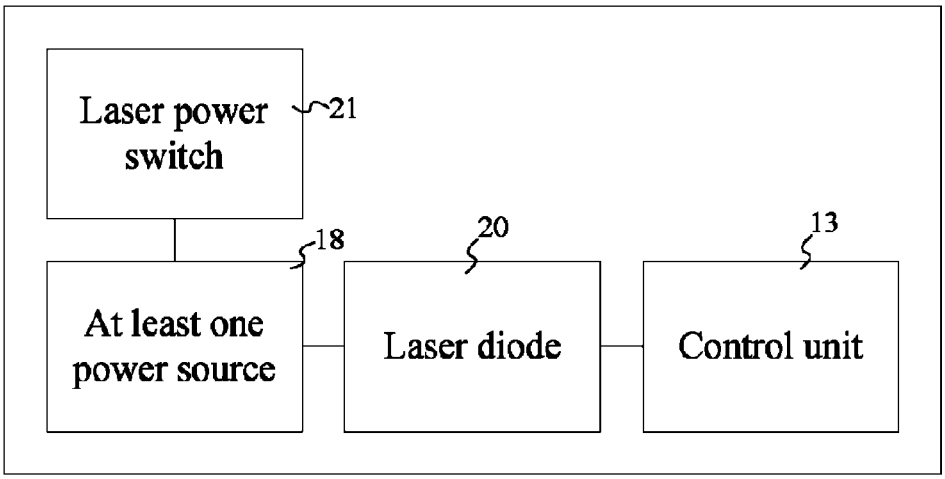
FIG. 8 is a diagram depicting electronic connections of the present invention for the laser diode.

In the embodiment of the present invention shown in FIGS. 6-8, the present invention further comprises a laser diode 20. The laser diode 20 enables use of the present invention as a laser in addition to use in providing conventional illumination. The laser diode 20 is particularly well-suited for use in conjunction with the finger tab 12 (for example, when delivering a presentation and directing the audience's attention with the laser diode 20). The laser diode 20 is positioned within the LED compartment 6, adjacent to the at least one multicolor LED 5. The laser diode 20 is thus oriented in the same direction as the at least one multicolor LED 5 and the laser produced by the laser diode 20 is able to emit from within the LED compartment 6. The laser diode 20 is electronically connected to the control unit 13, enabling the control unit 13 to process user commands such as when activating and deactivating the laser diode 20.

The present invention further comprises a laser power switch 21. The laser power switch 21 is utilized to activate and deactivate the laser diode 20. The at least one power source 18 is electrically connected to the laser diode 20 through the PCB 17, allowing the at least one power source 18 to provide electrical power to the laser diode 20. The laser power switch 21 is electrically connected to the at least one power switch, allowing the user to activate or deactivate the laser diode 20 via the laser power switch 21.

Figure 9:
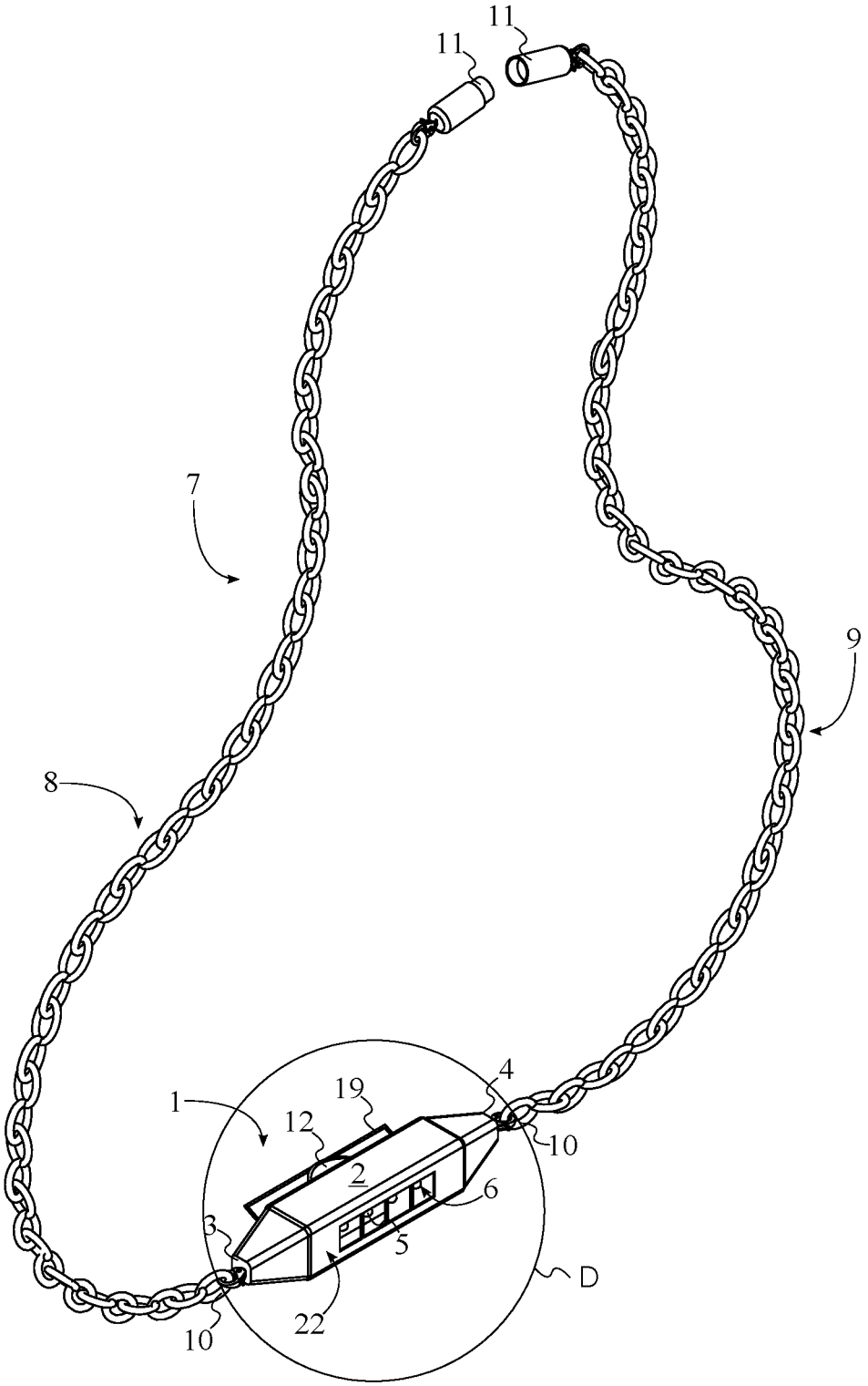
FIG. 9 is a front perspective view of an embodiment of the present invention comprising a ported light-transmission panel.
Figure 10:
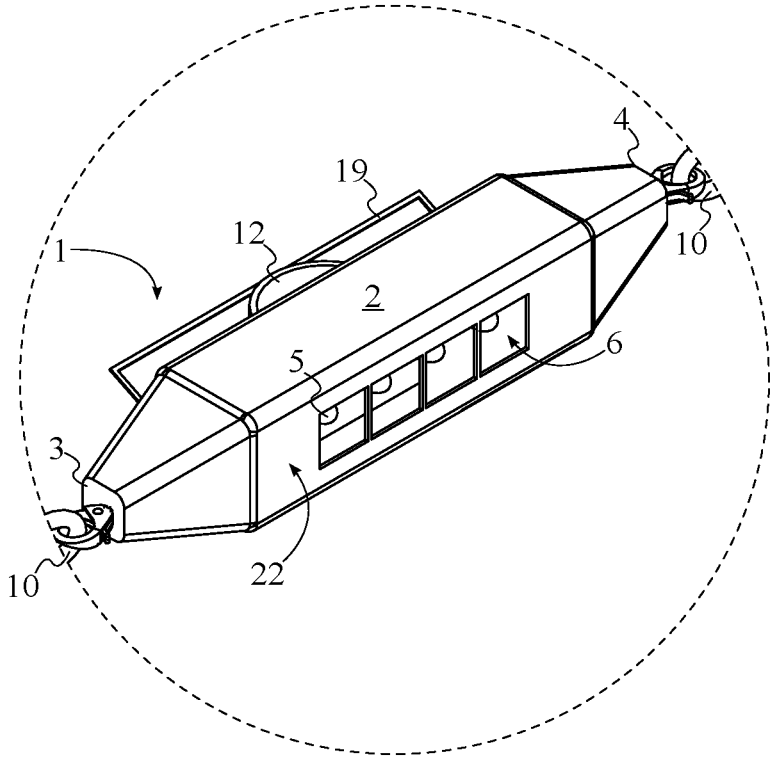
FIG. 10 is a detail view of the present invention taken from circle D of FIG. 9.

In the embodiment of the present invention shown in FIG. 9 and FIG. 10, the present invention further comprises a ported light-transmission panel 22. The ported light-transmission panel 22 aesthetically alters the light emitted by the at least one multicolor LED 5. The ported light transmission panel may include a monogram, a symbol, or other design through which light is able to pass. The ported light-transmission panel 22 is positioned across the LED compartment 6, adjacent to the lateral surface 2 and is thus positioned such that light emitted from the at least one multicolor LED 5 is able to pass through the ported light-transmission panel 22.

Although the present invention has been explained in relation to its preferred embodiment, it is understood that many other possible modifications and variations can be made without departing from the spirit and scope of the present invention as hereinafter claimed.

What is claimed is:

1. A wearable lighting device comprising:

a housing;

at least one multicolor light-emitting diode (LED);

an LED compartment;

a necklace;

a finger tab;

a control unit;

a ported light-transmission panel;

a prop stand;

the housing comprising a lateral surface, a first end and a second end;

the lateral surface being formed in between the first end and the second end;

the necklace comprising a first portion and a second portion;

the first portion and the second portion each comprising a tethering end and a fastening end;

the LED compartment traversing into the lateral surface;

the at least one multicolor LED being positioned within the LED compartment;

the tethering end of the first portion being releasably engaged to the first end;

the tethering end of the second portion being releasably engaged to the second end;

the fastening end of the first portion being releasably engaged to the fastening end of the second portion;

the finger tab being externally connected to the lateral surface;

the finger tab being located opposite to the at least one multicolor LED;

the at least one multicolor LED being electronically connected to the control unit;

the ported light-transmission panel being positioned across the LED compartment;

the ported light-transmission panel being located adjacent to the lateral surface;

the prop stand being hingedly connected across the lateral surface;

the prop stand being located opposite to the at least one multicolor LED;

the prop stand comprising two end portions and a middle portion;

the middle portion being connected in between the two end portions;

the middle portion being positioned across the lateral surface; and the two end portions being hingedly connected with the lateral surface.

2. The wearable lighting device as claimed in claim 1 comprising:

a brightness adjustment switch;

a color adjustment switch;

a power switch; and the brightness adjustment switch, the color adjustment switch and the power switch being positioned on the lateral surface.

3. The wearable lighting device as claimed in claim 2 comprising:

the brightness adjustment switch being a scroll wheel; and the brightness adjustment switch being rotatably mounted into the lateral surface.

4. The wearable lighting device as claimed in claim 1 comprising:

a printed circuit board (PCB);

a brightness adjustment switch;

a color adjustment switch;

a power switch;

at least one power source;

the PCB being seated into the LED compartment;

the at least one power source being enclosed within the housing;

the brightness adjustment switch and the color adjustment switch being electronically connected to the control unit through the PCB;

the at least one power source being electrically connected to the at least one multicolor LED through the PCB; and the power switch being electrically connected to the at least one power source.

5. The wearable lighting device as claimed in claim 1 comprising:

a laser diode;

the laser diode being positioned within the LED compartment, adjacent to the at least one multicolor LED; and the laser diode being electronically connected to the control unit.

6. The wearable lighting device as claimed in claim 5 comprising:

a PCB;

a laser power switch;

at least one power source;

the at least one power source being electrically connected to the laser diode through the PCB; and the laser power switch being electrically connected to the at least one power source.

7. The wearable lighting device as claimed in claim 1 comprising:

the fastening end of the first portion and the fastening end of the second portion being magnetically engaged to each other.

* * * * *